US005325926A

United States Patent [19]

Lay et al.

[11] Patent Number: 5,325,926

[45] Date of Patent: Jul. 5, 1994

[54] REVERSIBLE CASING FOR A DOWN-THE-HOLE PERCUSSIVE APPARATUS

[75] Inventors: Warren T. Lay; Leland H. Lyon, both of Roanoke, Va.

[73] Assignee: Ingersoll-Rand Company, Woodcliff Lake, N.J.

[21] Appl. No.: 14,441

[22] Filed: Feb. 5, 1993

[51] Int. Cl.[5] ..... E21B 4/06; B23Q 5/033

[52] U.S. Cl. ..... 166/380; 175/320; 175/293; 173/17

[58] Field of Search ..... 175/100, 293, 295, 296; 173/14, 17, 73, 78, 80, 122, 128, 137; 166/380

[56] References Cited

U.S. PATENT DOCUMENTS

| | | | |
|---|---|---|---|
| 3,941,196 | 3/1976 | Curington et al. | 175/100 |
| 3,958,645 | 5/1976 | Curington | 173/17 |
| 4,084,646 | 4/1978 | Kurt . | |
| 4,094,364 | 6/1978 | Lundstrom et al. | 175/293 |
| 4,402,370 | 9/1983 | Gein et al. | 173/73 |
| 4,530,407 | 7/1985 | Rear | 173/73 |
| 4,790,390 | 12/1988 | Sweeny | 173/17 |
| 4,821,812 | 4/1989 | Ditzig . | |
| 4,921,052 | 5/1990 | Rear . | |
| 5,131,476 | 7/1992 | Harrington | 173/78 |
| 5,205,363 | 4/1993 | Pascale | 173/17 |

*Primary Examiner*—Ramon S. Britts
*Assistant Examiner*—Frank S. Tsay
*Attorney, Agent, or Firm*—John J. Selko

[57] ABSTRACT

A reversible casing for a down-the-hole drill has a predetermined snap ring groove length centered between the casing ends, based upon the casing bore, the snap ring groove depth and the snap ring body length, whereby a snap ring will be retained in the snap ring groove, while permitting lengthwise movement of the snap ring during reverse orientation of the casing.

10 Claims, 4 Drawing Sheets

REVERSIBLE CASING FOR A DOWN-THE-HOLE PERCUSSIVE APPARATUS

BACKGROUND OF THE INVENTION

This invention relates generally to fluid actuated, percussive, down-the-hole drills, and more particularly to casings that serve as the outer body for such drills.

Fluid actuated down-the-hole drills typically use a system of internal cylinders or feed tubes to perform the fluid conveying or porting functions required of the air cycle. These internal parts must be retained within the central bore of the drill casing. In order to maximize cylinder bore diameter and retain these components in the correct lengthwise position, a retaining snap ring which fits into a groove undercut in the casing is provided as a shouldering means. Manufacturing considerations such as the need for boring, grinding or honing prohibit the formation of an internal shoulder which is part of the casing, or wear sleeve. However, a one-piece casing with an integral shoulder, or a factory installed and non-removable ring, would be desirable to keep the number of serviced parts to a minimum and to avoid damage to this sensitive area during repair servicing.

In addition, it is desirable to provide the casing in a form that it is reversible lengthwise because after the front end of the casing becomes worn and abraded from use at the drilling interface, the casing can be reversed lengthwise to position the unworn casing end at the drilling interface, thereby prolonging the useful life of the casing. Such a reversible casing must provide its snap ring groove with a length greater than the body length of the snap ring, in order to permit installation of the snap ring. Because the snap ring groove is positioned at a location midway between the casing ends, it is a problem for the person assembling the drill to precisely align and insert a snap ring, unless the snap ring groove length is greater than the snap ring body length. However, if the snap ring groove length is too long, for a particular bore and snap ring, the snap ring can become "skewed" or "rotated" and lose its interference fit in the groove, and freely fall out when the casing is empty, as when the drill internal parts are being repaired.

The foregoing illustrates limitations known to exist in present reversible casings. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a reversible casing with a snap ring groove length in the range of 0.25–7.80 inches for a bore diameter between 2.0–10.0 inches when the groove has a snap ring shoulder ratio between 10.0–150.0 and a snap ring aspect ratio between 1.0–6.0.

The foregoing and other aspects will become apparent from the following detailed description of the invention when considered in conjunction with the accompanying drawing figures.

BRIEF DESCRIPTION OF THE DRAWING FIGURES

Figure 4:
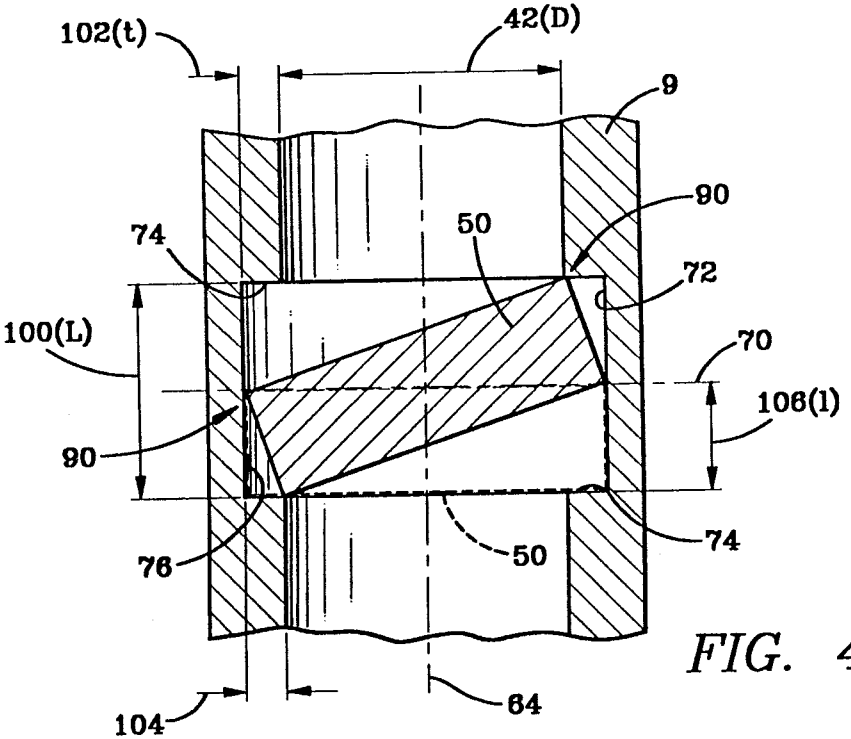

FIG. 4 is a schematic longitudinal cross sectional view of a snap ring in a snap ring groove of a casing, with the snap ring skewed to the position that it is about to lose its interference fit and fall out of the groove, and the snap ring in normal position in phantom; and FIGS. 5–8 are curves depicting the relationship between snap ring groove length, bore, snap ring shoulder ratio and snap ring aspect ratio.

DETAILED DESCRIPTION

Figure 1:
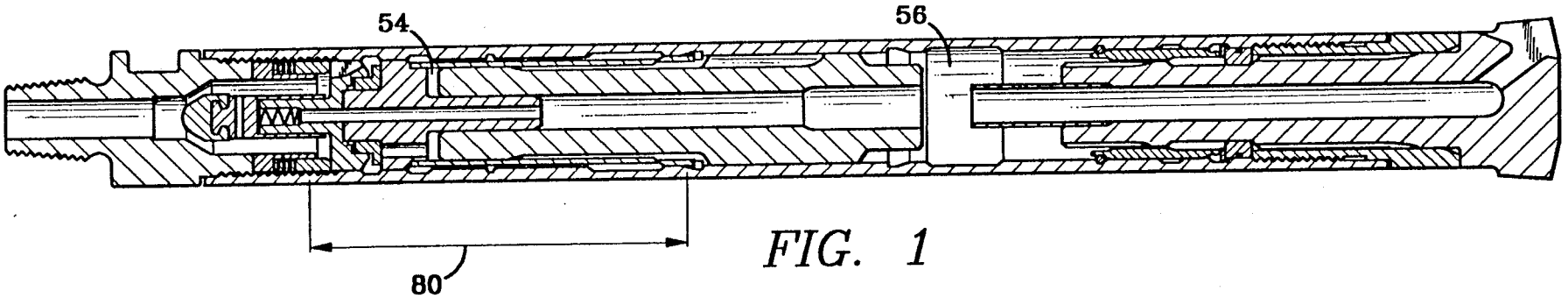
FIG. 1 is a longitudinal section of a down-the-hole drill having the casing of the invention, with the piston in the drive position.
Figure 2:
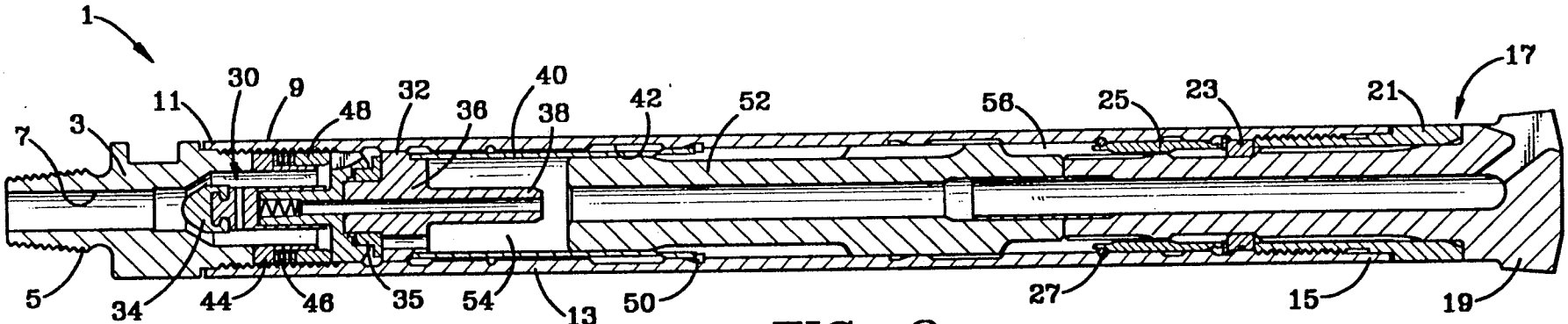
FIG. 2 is a view similar to FIG. 1, with the piston in the return position.

In order to disclose this invention, it is necessary to describe its relationship with a workable down-the-hole drill. Accordingly, one embodiment of such a drill is described hereinafter. Referring to FIGS. 1 and 2, a fluid actuated impact tool is shown generally as 1. The device is adapted to be suspended from a drill string (not shown). The drill is provided with a backhead coupling 3 having a threaded section 5 for threadable connection to the drill steel. The backhead coupling 3 has a bore 7 therethrough for flow of percussive fluid, as is well known. A hollow, elongated tubular casing 9 has a first end 11 threadably connected to the backhead coupling 3. Body portion 13 of casing 9 extends lengthwise to a second end 15, which is threadably connected to a fronthead portion, shown generally as 17.

Front head portion 17 includes a drill bit 19 slidably retained in a chuck 21 which is threaded to second end 15 of casing 9. A flexible retaining ring 23 positioned in casing 9 above chuck 21 and a sleeve 25 with a second split ring 27 in an undercut in casing 9 completes the fronthead 17 combination. The fronthead elements are described for clarity only, and form no part of the invention.

Backhead assembly portion, shown generally as 30, includes an air distributor 32, disposed in casing 9. A check valve 34 in bore 7 is also part of backhead assembly 30, to prevent reverse flow of air in the drill, as is well known. Air distributor 32 includes a valve member 35 that opens and closes during operation of the device to permit fluid flow into various passageways, as is well known. The air distributor 32 includes a body portion 36 that has an extended exhaust rod 38 thereon, also as is conventional. The air distributor 32 also includes a cylinder sleeve 40 that extends lengthwise along casing 9. The combination of elements described, including the check valve 32, the air distributor 32, the exhaust rod 38, the cylinder sleeve 40, are retained in bore 42 of casing 9 by coupling 3 threaded into casing end 11 and pressing against first collar 44, which rides on spring 46 seated on second collar 48. The backhead portions are described herein for clarity, and form no part of the invention.

The backhead assembly 30 is supported at a forward end in casing 9 by a split snap ring 50. Snap ring 50 is centered between first and second casing ends 11 and 15, respectively, as described hereinafter.

Piston 52 is slidable between backhead assembly 30, as shown in FIG. 1 and fronthead 17, as shown in FIG.

2, as is well known. Piston 52 forms part of the backhead assembly 30 when piston 52 is located in the drive position, as shown in FIG. 1, and it forms part of the fronthead 17, when piston 52 is located in the return position, as shown in FIG. 2. Piston 52 has a plurality of grooves, undercuts and land contact surfaces, as is well known. During drill operation, drive chamber 54 and return chamber 56 alternately expand and contract in volume, as well as exhaust and compress the percussive fluid, as is well known.

Figure 3:
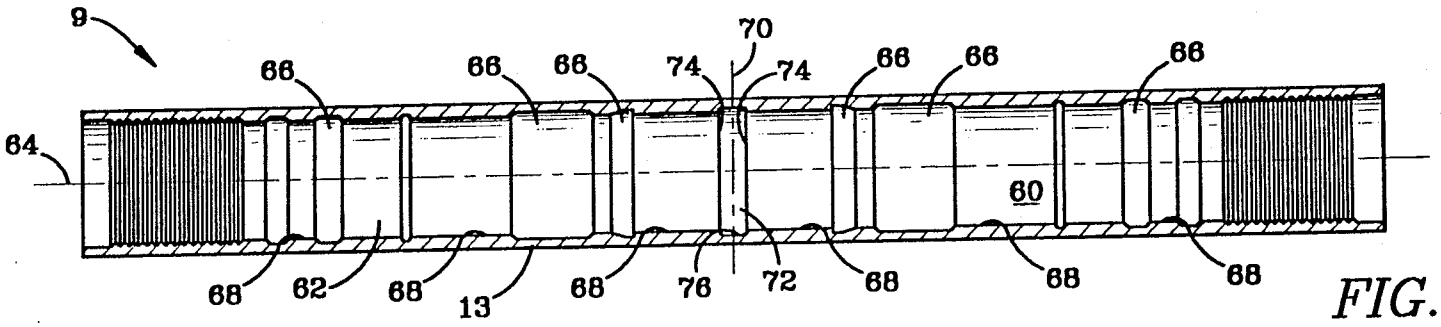
FIG. 3 is longitudinal cross section of the casing of the invention.

As shown more clearly on FIG. 3, the casing of this invention has an internal surface 60 that forms a bore 62 that has an axis 64 that extends lengthwise in the same direction as body 13 of casing 9, and which coincides with the axis of bore 7 of backhead coupling 3. The internal surface 60 of casing 9 has a profile that is provided by a plurality of undercut portions 66, alternating with land portions 68, which profile is manufactured by a boring or machining procedure, as is well known. The purpose of the profile is to combine with surfaces or undercuts in the piston 52, the backhead assembly 30 and the fronthead 17 to form various fluid passageways for flow of percussive fluid, to operate the drill, as is well known. The exact combination of lands 68 and undercuts 66 in the casing 9 and the surfaces or grooves in the other elements may vary from drill to drill, so long as the percussive reversal of the piston is achieved along with the exhaust of percussive fluid, as is well known.

The casing 9 of this invention is reversible lengthwise, as measured about centerline plane 70 (FIG. 3) transverse to the lengthwise direction of casing body 9, which plane is centered between first and second casing ends 11 and 15. In order for casing 9 to be reversible, first groove means (undercuts 66 and lands 68) between first casing end 11 and centerline 70 must be substantially the same as the second groove means (undercuts 66 and lands 68) between second casing 15 end and centerline 70. By substantially the same, we mean that the grooves at either end of casing 9 must provide the same functional fluid passageways, in combination with the backhead assembly 30 and fronthead 17, regardless of which casing end is connected to the fronthead or backhead. For best performance, and ease of manufacture of casing, we prefer that first groove means and second groove means are mirror images about centerline plane 70. However, slight variations away from mirror image can work, so long as the fluid passageways are formed substantially the same, regardless of lengthwise orientation of casing. Snap ring groove 72 is centered over plane 70, as seen in FIG. 3. Snap ring groove 72 is a flat-bottomed groove that extends radially from axis 64, as viewed in plane 70. Groove 72 consists of a pair of spaced apart, parallel radially extending sidewalls 74 with a base surface 76 therebetween. Groove 72 extends lengthwise along casing 9 and is centered about plane 70, to extend an equal distance on either side of plane 70.

As seen in FIGS. 1 and 2, the length of backhead assembly 30, indicated by numeral 80, is such that it does not fall on the exact centerline plane 70 of casing 9. Therefore, there will be a slight lengthwise movement of snap ring 50 back and forth in snap ring groove 72, depending upon which end of casing 9 the backhead assembly 30 is connected to.

However, as shown in FIG. 4, the lengthwise movement of snap ring 50 also permits it to "rotate" or "skew" out of the centerline plane 70. This "skewing" under certain conditions, permits the snap ring to lose its interference 90 with the snap ring groove sidewalls 74, and to thereby freely come out of the snap ring groove 72, when the operative elements of the drill backhead assembly 30 are not inside the casing 9, as when the drill is being repaired.

Referring to FIG. 4, various dimensional parameters will be described that must be balanced for proper design of down-the-hole drills, including the following:

a. casing bore 42 (termed D), having a circular cross section as measured in a radial direction from axis 64, in a plane 70, perpendicular to axis 64 and perpendicular to lengthwise direction of casing body 9;

b. a snap ring groove 72, having a length 100 (termed L), as measured in lengthwise direction of casing body 9;

c. a snap ring groove depth 102 (termed t), as measured in a radial direction from axis 64 in a plane 70, perpendicular to axis 64 and also perpendicular to lengthwise direction of casing body 9;

d. a snap ring groove shoulder 104, as measured radially from axis 64, and equal to snap ring groove depth t;

e. a snap ring shoulder ratio (termed r), calculated as the ratio of D/t;

f. a snap ring body length 106 (termed l), as measured in lengthwise direction of casing body 9; and g. a snap ring aspect ratio (termed k) , calculated as l/t.

The snap ring shoulder ratio (r) is a measure of the relative snap ring should size (load carrying area) within the casing 9. Design considerations such as load carrying capacity required to support the backhead assembly 30 and minimum wall thickness of the casing 9 must be taken into consideration when selecting the appropriate snap ring shoulder ratio. For example a shoulder ratio of 10.0 provides a large and strong shoulder size but also minimizes the wall thickness of the casing 9. A shoulder ratio of 150.0 provides a small shoulder and a maximized casing wall thickness.

The snap ring aspect ratio (k) is a measure of the relative bending strength of the snap ring 50. Design considerations such as strength and ease of installation must be considered when selecting this parameter. For example, a snap ring aspect ratio of 1.0 would provide a thin ring which would install easily but provide minimal bending strength. A snap ring with an aspect ratio of 6.0 would provide a very strong ring but may be difficult to install.

We have discovered that there is a relationship among the above-listed design elements whereby the maximum length (L) of a snap ring groove 72 can be predicted, which length (L) will permit lengthwise movement of the snap ring 50, while still retaining the snap ring 50 in the groove 72 by interference fit. The outer limits of such groove length (L) are listed in Table I, and shown graphically in FIGS. 5–7.

TABLE I

| Range of Max. Groove Length, L, (inches) | Range of Bore Diameter, D, (inches) | Range of Shoulder Ratio, r = D/t | Range of Snap Ring Aspect Ratio, k = l/t |
|---|---|---|---|
| 0.25–7.80 | 2.0–10.0 | 10.0–150.0 | 1.0–6.0 |
| 0.25–1.22 | 2.0–10.0 | 150.0 | 1.0 |
| 0.75–3.9 | 2.0–10.0 | 30.0 | 4.0 |
| 1.75–7.80 | 2.0–10.0 | 10.0 | 6.0 |

Figure 5:
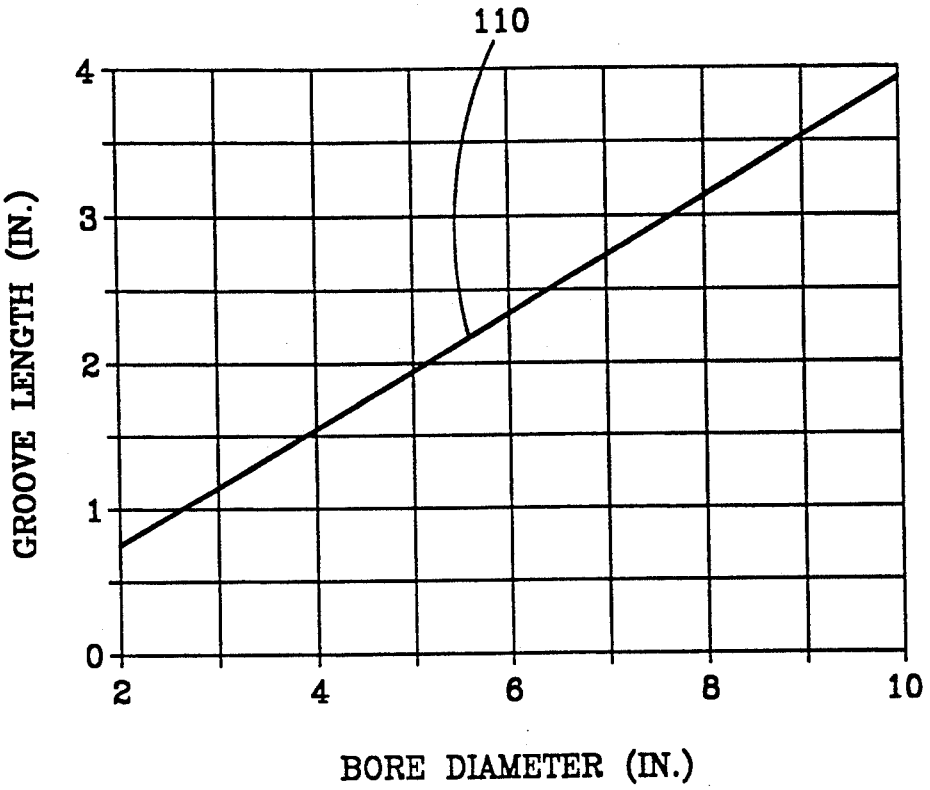
Figure 6:
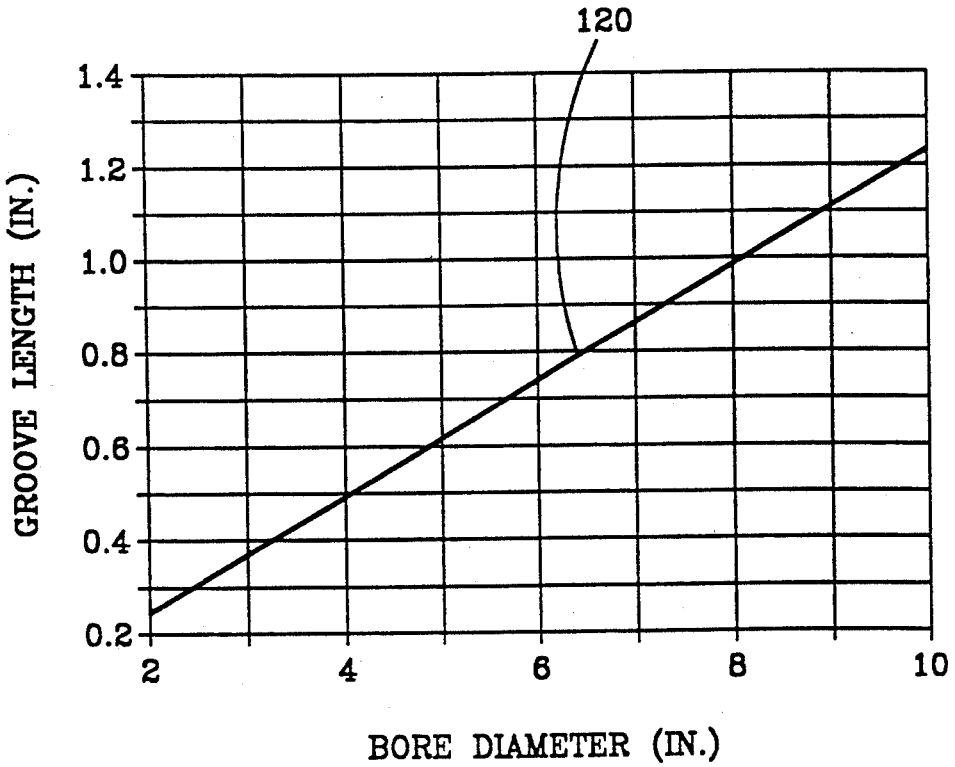
Figure 7:
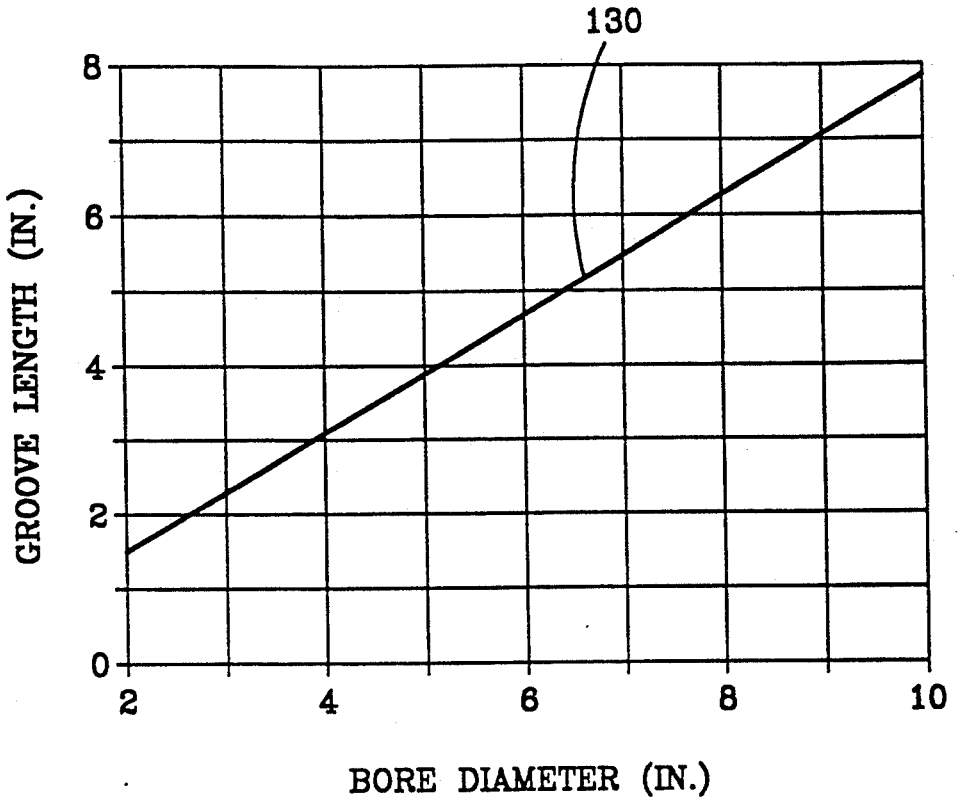
Figure 8:
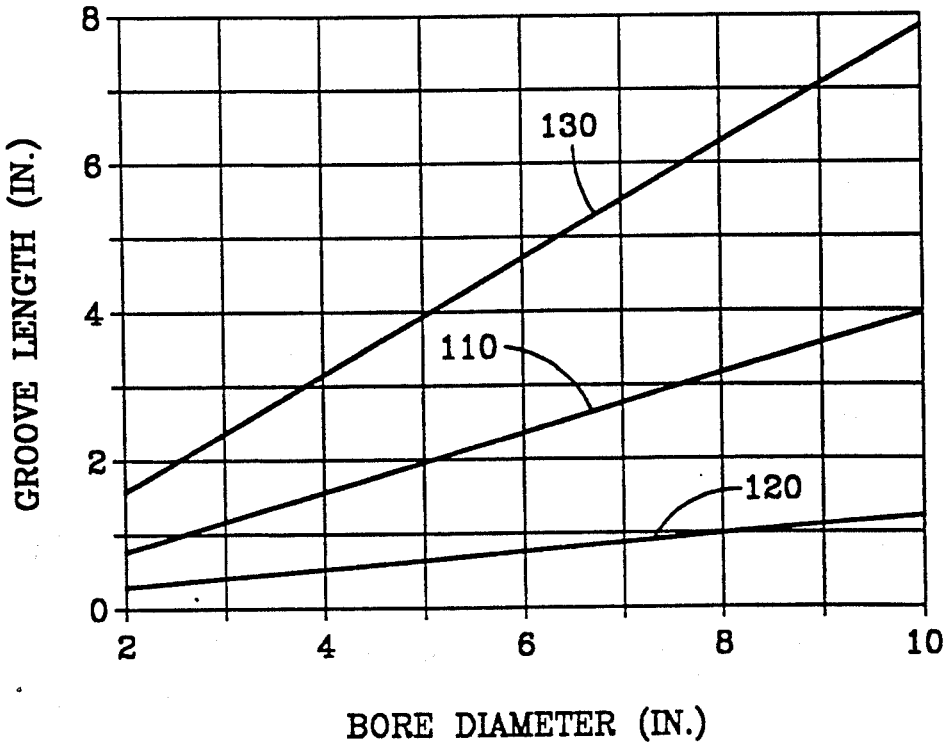

In FIG. 5 the preferred combination of shoulder ratio (r) and snap ring aspect ratio (k) are shown, for predicting the maximum acceptable groove length (L), for various diameter bores (D). Any groove length falling below the curve 110 will retain the snap ring 50 in the groove 72. Above the curve 110, the snap ring 50 will freely "skew" out of the groove 72. FIG. 6 shows the outer extreme of acceptable groove lengths (L) for a shallow groove depth (t) [r=150.0] and narrow ring body length (l) [k=1.0]. Any groove length (L) below the curve 120 is acceptable. FIG. 7 shows the outer extreme of acceptable groove lengths (L) for a deep groove depth (t) [r=10.0] and long ring body length (l) [k=6.0]. Any groove length (L) below the curve 130 is acceptable. FIG. 8 shows a combination of the curves of FIGS. 5-7.

Finally, it is understood that as used herein the term "snap ring" refers to the conventional, substantially circular, elastically deformable ring-type element that can be elastically deformed into small diameter, for insertion into a bore 42, during assembly of the drill. The ring will expand or "snap" into the groove 72 to press its outer diameter surface lightly against the bottom surface 76 of the groove, with its inner diameter surface extending a slight distance into bore 42, resulting in the support of backhead assembly 30, as described hereinabove. In such position, ring 50 is substantially permanently positioned in groove 72, being removable only with special tools and or special effort.

Having described the invention, what is claimed is:

1. A casing for a down-the-hole drill, said casing adapted to be connected at a first casing end to operative elements of a drill backhead and at a second casing end to operative elements of a drill fronthead, said casing being capable of being reversed lengthwise when one end thereof becomes abraded during use, comprising:

a. said casing having a snap ring groove with a snap ring groove length in the range of 0.25-7.80 inches for a casing bore diameter between 2.0-10.0 inches when the snap ring groove has a snap ring shoulder ratio between 10.0-15.0 and a snap ring aspect ratio between 1.0-6.0.

2. A casing for a down-the-hole drill, said casing adapted to be connected at a first casing end to operative elements of a drill backhead and at a second casing end to operative elements of a drill fronthead, said casing being capable of being reversed lengthwise when one end thereof becomes abraded during use, comprising:

a. an elongated, hollow tubular body extending in a lengthwise direction between said first casing end and said second casing end;

b. an internal surface on said body forming a bore having a diameter D, said bore having an axis extending in said lengthwise direction;

c. snap ring groove means in said internal surface for retaining therein a snap ring adapted for supporting operative drill backhead elements within said bore, said snap ring having a snap ring aspect ratio between 1.0 and 6.0, said snap ring groove means being substantially centered between said first and second casing ends, said snap ring groove means extending in a radial direction from said axis of said bore, as viewed in a plane transverse to said lengthwise direction of said body, said snap ring groove means having:

i. a length L, as measured in said lengthwise direction;

ii. a depth t, as measured in said radial direction; and iii. a shoulder ratio D/t, said length L having a maximum in the following ranges:

| Range of Max. Groove Length, L, (inches) | Range of Bore Diameter, D, (inches) | Range of Shoulder Ratio, r = D/t | Range of Snap Ring Aspect Ratio, k = l/t |
|---|---|---|---|
| 0.25-7.80 | 2.0-10.0 | 10.0-150.0 | 1.0-6.0 |

whereby a snap ring will be restrained by said snap ring groove means from skewing out of said snap ring groove when casing is not connected to operative elements of said drill; and d. said bore internal surface having a profile that is substantially a mirror image, as measured on either side of said snap ring groove means.

3. The casing of claim 2 wherein said snap ring groove means is formed by a pair of spaced apart, parallel, radially extending sidewalls, with a base surface extending lengthwise therebetween.

4. The casing of claim 3 wherein said profile comprises:

a. first groove means in said internal surface between said snap ring groove means and said first casing end, for supporting operative elements of a drill backhead in said bore and for defining, with said operative elements of a drill backhead, passageways for flow of percussive fluid therein, when said first casing end is connected to a drill backhead; and b. second groove means in said internal surface between said snap ring groove means and said second casing end, for supporting operative elements of a drill fronthead in said bore and for defining, with said operative elements of a drill fronthead, passageways for flow of percussive fluid therein, when said second casing end is connected to a drill fronthead.

5. The casing of claim 4 wherein said snap ring groove means base surface is centered between said first and second casing ends.

6. The casing of claim 5 wherein said first and second casing ends are threaded, for connection to a drill backhead and fronthead.

7. A method for producing a reversible casing for a down-the-hole drill, said casing being capable of being reversed lengthwise when one end thereof becomes abraded during use, comprising:

a. providing an elongated hollow tubular casing having a first casing end and a second casing end;

b. providing a bore formed by an internal surface therein;

c. providing a snap ring groove in said internal surface for retaining therein a snap ring adapted for supporting operative drill backhead elements within said bore, said snap ring having a snap ring aspect ratio between 1.0 and 6.0, said snap ring groove being substantially centered between said first and second casing ends, said snap ring groove extending in a radial direction from said axis of said bore, as viewed in a plane transverse to said lengthwise direction of said body, said snap ring groove having:

i. a length L, as measured in said lengthwise direction;

ii. a depth t, as measured in said radial direction; and iii. a shoulder ratio D/t, said length L having a maximum in the following ranges:

| Range of Max. Groove Length, L, (inches) | Range of Bore Diameter, D, (inches) | Range of Shoulder Ratio, r = D/t | Range of Snap Ring Aspect Ratio, k = l/t |
|---|---|---|---|
| 0.25–7.80 | 2.0–10.0 | 10.0–150.0 | 1.0–6.0 |

whereby a snap ring will be restrained by said snap ring groove from skewing out of said snap ring groove when casing is not connected to operative elements of said drill;

d. providing a first groove means in said internal surface between said snap ring groove and said first casing end, for supporting operative elements of a drill backhead in said bore and for defining, with said operative elements of a drill backhead, passageways for flow of percussive fluid therein, when said first casing end is connected to a drill backhead; and e. providing a second groove means in said internal surface between said snap ring groove and said second casing end, for supporting operative elements of a drill fronthead in said bore and for defining, with said operative elements of a drill fronthead, passageways for flow of percussive fluid therein, when said second casing end is connected to a drill fronthead.

8. The method of claim 7 wherein said snap ring groove base surface is centered between said first and second casing ends.

9. The method of claim 8 wherein said first and second casing ends are threaded, for connection to a drill backhead and fronthead.

10. The method of claim 9 wherein said first and second groove means are substantially mirror images, as measured about a centerline plane centered between said first and second casing ends.

* * * * *